United States Patent [19]

Boerger

[11] Patent Number: 4,694,575

[45] Date of Patent: Sep. 22, 1987

[54] CLIPPER ATTACHMENT DEVICE

[76] Inventor: Daniel A. Boerger, 5132 Norman St., Racine, Wis. 53406

[21] Appl. No.: 900,009

[22] Filed: Aug. 25, 1986

[51] Int. Cl.[4] ..... B26B 19/04

[52] U.S. Cl. ..... 30/221; 30/223

[58] Field of Search ..... 30/221, 222, 223, 224, 30/272 R, 272 A

[56] References Cited

U.S. PATENT DOCUMENTS

| | | | |
|---|---|---|---|
| 1,764,614 | 6/1930 | Dremel | 30/221 |
| 1,956,042 | 4/1934 | Oster | 30/221 |
| 3,153,852 | 10/1964 | Freeman | 30/272 A |
| 3,279,062 | 10/1966 | Andis | 30/221 X |
| 3,359,637 | 12/1967 | Hansen | 30/272 A |
| 4,081,905 | 4/1978 | Urbush | 30/221 |

*Primary Examiner*—Douglas D. Watts

*Attorney, Agent, or Firm*—Peter N. Jansson, Ltd.

[57] ABSTRACT

An improved clipper and improved cutter head attachment device of the type having a pair of mating members including a substantially flat male member and a female slot. One of the mating members has at least one resilient offset portion which must be squeezed into engagement against the other of the mating members when the cutter head is engaged with the main clipper body. This provides gap-free engagement which reduces noise and improves cutting performance.

14 Claims, 6 Drawing Figures

CLIPPER ATTACHMENT DEVICE

FIELD OF THE INVENTION

This invention is related generally to clippers for cutting hair and the like and, more particularly, to devices for removable engagement of cutter heads with the main body of a clipper.

BACKGROUND OF THE INVENTION

Clippers of the type having a fixed cutter with a first row of teeth and a movable cutter with a second row of teeth which reciprocates with respect to the first row have long been very well known. The rows of teeth of the fixed and movable cutters are substantially aligned and their relative movement produces cutting action between adjacent pairs of teeth.

The fixed and movable cutters are part of a cutter head assembly which is usually removably attachable to the main body of the clipper. Removal and reattachment of cutter heads occurs frequently, such as when the type of cutter is to be changed or the cutter requires cleaning.

Various devices have been used to faciliate removal and reattachment of cutter head assemblies from the main body of a clipper. The attachment means in most cases involves two mating members—a tongue-like substantially flat male member, which is usually pivotably attached to the main body of the clipper, and a generally complementary female slot, which is normally formed on one side of the cutter head. The flat male member is received into the female slot when the cutter head and main body are engaged.

To attach the cutter head, the cutter head is moved onto the flat male member, that is, the female slot is inserted over the flat male member. Then the cutter head is pivoted with the flat male member until one surface of the cutter head, that is, the surface on which the female slot is situated, engages an end surface of the main body of the clipper. In such position, the mechanical drive linkage in the main body of the clipper engages the movable cutter and the clipper is ready for operation.

The tongue-and-slot attachment means of the prior art have been unsatisfactory for various reasons, and it is to improvement of such attachment means that this invention is directed.

In particular, such attachment means of the prior art have not provided sufficiently tight mating engagement between the cutter head and the main body of the clipper. Instead, their engagement is frequently loose and is a source of noise such as rattling while the clippers are in operation. Noise can be unsettling to a pet during pet grooming, or to many other animals during shearing, and thus can cause delays in the cutting operations.

Furthermore, with such looseness the cutter heads in some cases vibrate excessively rather than remaining in a stable fully-effective cutting position. Thus, in addition to the annoying noise problem, cutter heads of the prior art may cause pulling of hair and the resulting discomfort during cutting. Inaccuracy in cutting can even result, particularly in fine trimming operations.

Various modifications and devices have been used for the purpose of improving the engagement of such mating members. However, the problems associated with loose attachment of the cutter head, particularly the presence of an excessive rattling noise, have remained essentially unsolved. There is a need for a means for firmer engagement between cutter heads and clipper bodies in order to eliminate the problems associated with loose connection.

OBJECTS OF THE INVENTION

It is an object of this invention to provide a clipper and a removable cutter head attachment device which overcomes certain problems of the prior art, including those mentioned above.

Another object of this invention is to provide a clipper which is quiet in operation.

Another object is to provide a clipper with a firmly attached cutter head for improved cutting performance.

Another object of this invention is to provide an improved clipper cutter head engagement device which overcomes the aforementioned problems and yet is simple and inexpensive in construction.

These and other important objects will be apparent from the descriptions of this invention which follow.

SUMMARY OF THE INVENTION

This invention is an improved clipper and an improved cutter head engagement means overcoming certain problems and disadvantages of prior art devices. More specifically, this invention is an improvement in the aforementioned mating members, involving a modification in the relationship of the substantially flat male member with the female slot.

In this invention, one of such mating members has at least one resilient offset portion which, in order for the flat male member and female slot to be engaged, must be squeezed against the other of the mating members. The resilient offset portion applies outward pressure such other mating member to eliminate any gap between the substantially flat male member and the female slot in which it is inserted.

Such outward pressure is preferably provided by the use of spring steel for the resilient offset portion and for all or most of the mating member of which it is a part. The offset portion is, by its own natural spring tension and resilience, biased to a position requiring that it be depressed in order for the mating members to be engaged.

There may be one of such resilient offset portions or there may be more than one. In preferred embodiments, the mating member which has such resilient offset portion(s) is the male member. In preferred embodiments, the substantially flat male member preferably extends from the main body of the clipper while the female slot is formed in the cutter head. However, the reverse configuration is possible as well.

In preferred embodiments, the female slot has first and second walls spaced apart by a fixed distance. The male member has a first side which is engageable with the first wall of the female slot and the resilient offset is a strip on the male member naturally biased to a position which is spaced from the first side of the male member by a distance greater than the fixed spacing between the walls of the female slot. In this configuration, the resilient offset portion applies pressure against the second wall of the female slot when the cutter head and main body of the clipper are engaged.

In highly preferred embodiments, the male member, which has the resilient offset portion, includes a principal portion and a partially cut-out portion which is integral with the principal portion. The partially cut-out portion forms the aforementioned strip which is the resilient offset portion. Such male member is preferably formed of spring steel.

In certain preferred embodiments of the type just described, the second wall of the female slot has an indentation, such as a hole through it, which is positioned to receive part of the partially cut-out portion (or strip) when the cutter head and main body of the clipper are fully engaged. This serves to secure the cutter head in its position of full engagement with the main body. As the two mating parts are joined, the position of full engagement will cause a "click" which indicates full engagement.

The substantially flat male member, as previously noted, is preferably hinged to the main body of the clipper. The end of the male member which is closest to such hinges may be referred to as the attached end, and such definition is given in order to describe a preferred orientation of the aforementioned resilient cut-out portion or strip. The cut-out portion has a proximal end and a distal end, and in certain preferred embodiments the distal end is closer than the proximal end to such attached end of the male member. Thus, the cut-out member "points back" at the main body of the clipper, which facilitates engagement and disengagement of the cutter head from the main body since it is not necessary for the cutter head to slide against the distal end of the cut-out portion.

DETAILED DESCRIPTIONS OF PREFERRED EMBODIMENTS

Figure 1:
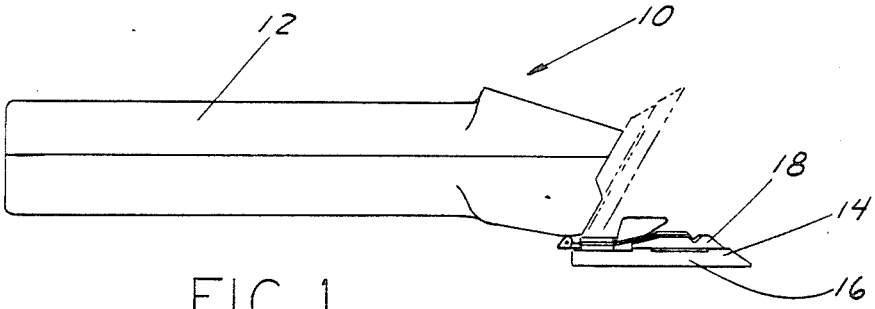
FIG. 1 is a side elevation of a clipper 10 in accordance with this invention.

The figures illustrate a preferred clipper 10 used for cutting hair and the like. Clipper 10 includes a handle 12 which, with the internal parts attached to it (not shown), forms the main body of clipper 10. Clipper 10 also has a removable cutter head 14, which includes fixed cutter 16 and movable cutter 18, and a pair of mating members hereafter described.

Cutter head 14 also includes a bracket 20 which is attached to fixed cutter 18 by means of screws 22. A U-shaped blade tension spring 24 is also secured to fixed cutter 16 by screws 22, sandwiching bracket 20 in place. Blade tension spring 24 holds movable cutter 18 firmly against fixed cutter 16 during the reciprocating movement thereof which is imparted to fixed 16 by mechanical linkages not shown.

Bracket 20 and the rear portion 26 of fixed cutter 16 form a generally rectangular female slot 28 on cutter head 14. Bracket 20 includes flat side portions 30 in direct contact with the upper surface 34 of rear portion 26 of fixed cutter 16. Bracket 20 also includes a flat raised portion 32 which is spaced above the upper surface 34 of rear portion 26 of fixed cutter 16.

Upper surface 34 of fixed cutter 16 is sometimes referred to herein as a first wall of female slot 28, and the lower surface 36 of raised portion 32 of bracket 20 is sometimes referred to as a second wall of female slot 28. Upper surface 34 and lower surface 36 are spaced apart by a fixed distance.

As shown best in FIGS. 2, 4, 5, and 6, main body 12 of clipper 10 includes a substantially flat male member 38 which is hinged to main body 12 by means of hinge axis 40. Flat male member 38 is a mating member which is engageable in female slot 28, as will hereafter be explained in detail. Male member 38, sometimes referred herein as a tongue, may be pivoted about hinge axis 40 such that, after male member 38 and female slot 28 are engaged, cutter head 14 can be pivoted on male member to its operational position over the end of main body 12 of clipper 10.

FIG. 1 illustrates cutter head 14 in full lines in its position of initial engagement and in phantom lines in its final operational position. In both positions, female slot 28 is fully engaged over male member 38.

Figure 5:
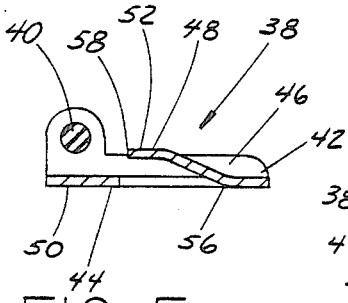
FIG. 5 is a further enlarged fragmentary side sectional view, taken along section 5—5 as indicated in FIG. 2, with the cutter head removed.
Figure 6:
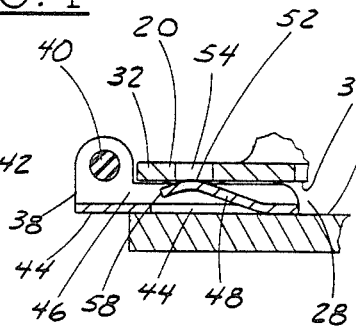
FIG. 6 is another fragmentary side sectional view similar to FIG. 5, but showing the two mating members fully engaged.
Figure 4:
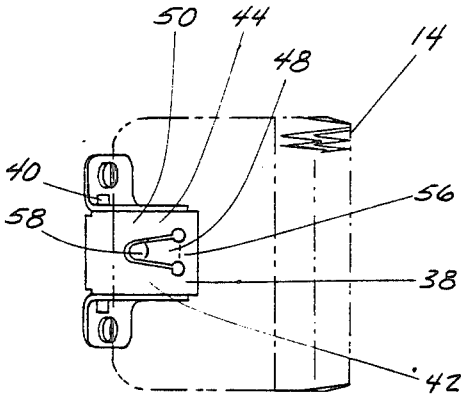
FIG. 4 is another bottom plan view, but having the cutter head in phantom lines to more fully show one of the mating members.
Figure 3:
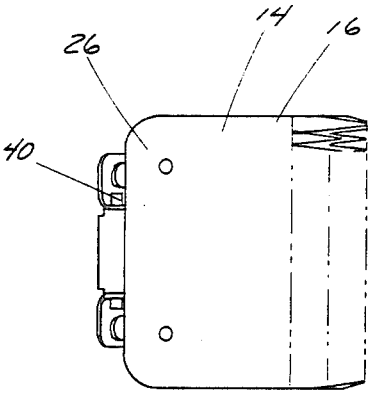
FIG. 3 is a bottom plan view of FIG. 2.

Male member 38, the details of which are best illustrated in FIGS. 4, 5, and 6, has a principal portion 42 which includes a flat center portion 44 and turned-up portions 46 along its opposite side edges. Turned-up portions 46 give principal portion 42 of male member 38 substantial rigidity. Male member 38 also has a partially cut-out strip portion 48 which is integral with principal portion 42.

Strip portion 48 forms a resilient offset portion, that is, a portion of male member 38 which is raised or offset from flat center portion 44. Strip portion 48 is offset to the extent that it must be squeezed toward flat portion 44 in order for male member 38 to be fully inserted within female slot 28.

Figure 2:
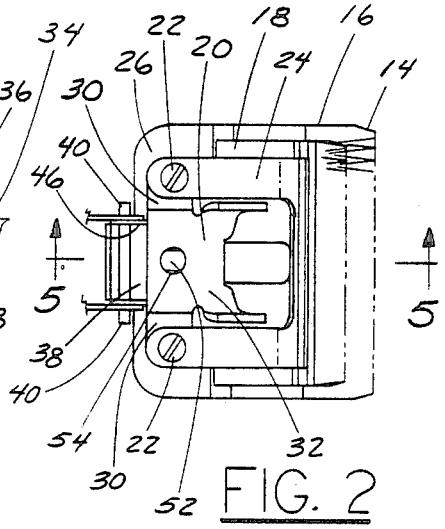
FIG. 2 is an enlarged fragmentary top plan view of a portion of FIG. 1, having the main body of the clipper removed to more fully illustrate the cutter head and the pair of mating members.

Male member 38 includes a bottom surface 50, sometimes referred to herein as the first side, which contacts upper surface 34 of fixed cutter 16 when male member 38 and female slot 28 are engaged. Strip portion 48 of male member 48 has a top surface 52 which is in contact with lower surface 36 of bracket 20 when male member 38 and female slot 28 are engaged. Such contact and engagement are illustrated in FIGS. 2 and 6.

FIGS. 5 and 6 illustrate the action of strip portion 48. When male member 38 and female slot 28 are not engaged, as shown in FIG. 5, resilient strip portion 48 is shown biased to its natural position such that top surface 52 of strip portion 48 is spaced from bottom surface 50 of male member 38 by a distance greater than the aforementioned fixed distance, that is, the spacing between lower surface 36 and upper surface 34 of female slot 28. When female slot 28 is slid over male member 38, it depresses resilient cut-out strip portion 48, as shown in FIG. 6, and the upward spring pressure of strip portion 48 serves to hold male member 38 in firm gap-free engagement with female slot 28.

Raised portion 32 of bracket 20 includes an opening 54 which is positioned such that, upon full insertion of male member 38 in female slot 28, part of cut-out strip portion 48 is at least partially received into opening 54. Opening 54 or any other indention at that position thus serves to further secure cutter head 14 in its engagement with main body 12 of clipper 10.

Male member 38, including principal portion 42 and cut-out strip portion 48, is preferably formed of a single piece of spring steel. Other materials having similar hardness and resilience properties can be used instead of spring steel.

In the preferred embodiment shown, partially cut-out resilient strip portion 48 has a proximal end 56, by which it is attached to the remainder of male member 38, and a distal end 58. Distal end 58 is closer to the end of male member 38 which is secured to main body 12 of clipper 10. This orientation of cut-out strip portion 48 facilitates engagement and disengagement of cutter head 14.

While it is highly preferred that the resilient offset portion be formed on the male member, it could be formed on one or both of the walls of the female slot. It is only important that such resilient offset portion provide outward pressure against the other mating member such that the engagement of the male member and the female slot is essentially gap free.

While it is highly preferred that there be a single resilient offset portion, more than one can be used. Indeed, in some cases a pair of side-by-side offset portions, preferably both on the male member, can be used. In some cases, resilient offset portions can be on both the male and female members.

While partially cut-out offset portions integrally formed with the remainder of the mating member of which they are a part are preferred, such cut-out configuration and integral construction are not required. The offset portion can instead be attached by welding or in some other fashion.

The parts used in making clipper 10 may be made of well-known and readily available materials. Various common parts and connectors well known in the art may also be used.

While the principles of this invention have been described in connection with specific embodiments, it should be understood clearly that these descriptions are made only by way of example and are not intended to limit the scope of the invention.

What is claimed is:

1. A clipper of the type having a main body and a pivotably-mounted cutter head with a fixed blade and a reciprocating blade, comprising:

male and female connecting members including one on the main body and the other on the cutter head;

the female connecting member being a slot formed of first and second substantially planar principal wall members spaced apart by a fixed distance;

the male connecting member being a substantially planar member of principal thickness less than said fixed distance for easy insertion into said slot; and one of the substantially planar members having a resilient portion offset from the plane thereof by a distance greater than the fixed distance less the principal thickness, and biased therefrom in a direction normal to said plane, whereby looseness between said planar members is eliminated.

2. The clipper of claim 1 wherein the one mating member is the male member.

3. The clipper of claim 2 wherein:

the male member has a first side engageable with the first wall member; and the resilient offset portion is a strip on the male member which is biased to a position spaced from the first side by a distance greater than the fixed distance such that it applies pressure against the second wall member when the head and body are engaged.

4. The clipper of claim 3 wherein the male member comprises a principal portion and a partially cut-out portion which is integral with the principal portion, said cut-out portion forming the strip.

5. The clipper of claim 4 wherein the member has an indentation positioned to receive part of the cut-out portion when the head and body are engaged, thereby to secure the cutter head in its engagement with the main body.

6. The clipper of claim 4 wherein the male member, including the principal and cut-out portions, is formed of a piece of spring steel.

7. The clipper of claim 6 wherein the second wall member has an indentation positioned to receive part of the cut-out portion when the head and body are engaged, thereby to secure the cutter head in its engagement with the main body.

8. The clipper of claim 1 wherein the one connecting member is the male member, the male member extends from the main body, and the female slot is formed in the cutter head.

9. The clipper of claim 8 wherein:

the male member has a first side engageable with the first wall member; and the resilient offset portion is a strip on the male member which is biased to a position spaced from the first side by a distance greater than the fixed distance such that it applies pressure against the second wall member when the head and body are engaged.

10. The clipper of claim 9 wherein the male member comprises a principal portion and a partially cut-out portion which is integral with the principal portion, said cut-out portion forming the strip.

11. The clipper of claim 10 wherein the second wall member has an indentation positioned to receive part of the cut-out portion when the head and body are engaged, thereby to secure the cutter head in its engagement with the main body.

12. The clipper of claim 10 wherein the male member, including the principal and cut-out portions, is formed of a piece of spring steel.

13. The clipper of claim 12 wherein the second wall member has an indentation positioned to receive part of the cut-out portion when the head and body are engaged, thereby to secure the cutter head in its engagement with the main body.

14. The clipper of claim 10 wherein:

the male member includes an attached end which is secured to the main body; and the cut-out portion has a proximal end and a distal end, the distal end being closer than the proximal end to said attached end, thereby facilitating engagement and disengagement of the cutter head from the main body.

* * * * *